US008864445B2

(12) United States Patent
Coign et al.

(10) Patent No.: US 8,864,445 B2
(45) Date of Patent: Oct. 21, 2014

(54) TURBINE NOZZLE ASSEMBLY METHODS

(75) Inventors: Robert Walter Coign, Piedmont, SC (US); Aaron Gregory Winn, Piedmont, SC (US)

(73) Assignee: General Electric Company, Schenectady, NY (US)

( * ) Notice: Subject to any disclaimer, the term of this patent is extended or adjusted under 35 U.S.C. 154(b) by 485 days.

(21) Appl. No.: 13/345,777

(22) Filed: Jan. 9, 2012

(65) Prior Publication Data

US 2013/0177447 A1 Jul. 11, 2013

(51) Int. Cl.
*F01D 9/06* (2006.01)

(52) U.S. Cl.
USPC ..... 415/116; 29/889.2; 29/889.22

(58) Field of Classification Search
CPC ..... F01D 9/23; F01D 25/12; F05D 2260/201
USPC ..... 415/115, 116; 29/889.2, 889.22
See application file for complete search history.

(56) References Cited

U.S. PATENT DOCUMENTS

| | | | | |
|---|---|---|---|---|
| 3,558,237 | A * | 1/1971 | Wall | 415/115 |
| 4,187,054 | A | 2/1980 | Landis, Jr. et al. | |
| 4,962,640 | A * | 10/1990 | Tobery | 60/782 |
| 5,197,852 | A | 3/1993 | Walker et al. | |
| 5,609,466 | A | 3/1997 | North et al. | |
| 5,964,250 | A * | 10/1999 | Mueller | 138/109 |
| 6,065,928 | A * | 5/2000 | Rieck et al. | 415/115 |
| 6,227,798 | B1 | 5/2001 | Demers et al. | |
| 6,382,906 | B1 | 5/2002 | Brassfield et al. | |
| 6,383,602 | B1 | 5/2002 | Fric et al. | |
| 6,386,825 | B1 | 5/2002 | Burdgick | |
| 6,418,618 | B1 | 7/2002 | Burdgick | |
| 6,761,529 | B2 | 7/2004 | Soechting et al. | |
| 6,769,865 | B2 * | 8/2004 | Kress et al. | 415/113 |
| 6,932,568 | B2 | 8/2005 | Powis et al. | |
| 6,984,101 | B2 | 1/2006 | Schiavo, Jr. | |
| 7,029,228 | B2 | 4/2006 | Chan et al. | |
| 7,252,481 | B2 | 8/2007 | Stone | |
| RE40,658 | E | 3/2009 | Powis et al. | |
| 7,540,707 | B2 * | 6/2009 | Dervaux et al. | 415/135 |
| 2002/0028134 | A1 | 3/2002 | Burdgick | |
| 2002/0182057 | A1 | 12/2002 | Liotta et al. | |
| 2002/0187040 | A1 | 12/2002 | Predmore | |
| 2005/0244267 | A1 | 11/2005 | Coign et al. | |
| 2006/0053798 | A1 | 3/2006 | Hadder | |
| 2006/0062673 | A1 | 3/2006 | Coign et al. | |
| 2006/0073011 | A1 | 4/2006 | Lee et al. | |
| 2006/0216140 | A1 * | 9/2006 | Dervaux et al. | 415/115 |
| 2007/0237624 | A1 | 10/2007 | Nigmatulin | |
| 2008/0089780 | A1 | 4/2008 | Erickson et al. | |
| 2008/0152488 | A1 | 6/2008 | Kammel et al. | |
| 2010/0011773 | A1 | 1/2010 | Suleiman et al. | |
| 2010/0068041 | A1 | 3/2010 | Nigmatulin et al. | |
| 2010/0278631 | A1 | 11/2010 | Heda et al. | |
| 2010/0281879 | A1 | 11/2010 | Shapiro et al. | |
| 2010/0284800 | A1 | 11/2010 | Sewall et al. | |
| 2011/0014045 | A1 | 1/2011 | McCall | |
| 2011/0014054 | A1 | 1/2011 | Nagler et al. | |
| 2011/0044803 | A1 | 2/2011 | DiPaola et al. | |

* cited by examiner

*Primary Examiner* — Edward Look
*Assistant Examiner* — William Grigos
(74) *Attorney, Agent, or Firm* — Sutherland Asbill & Brennan LLP

(57) ABSTRACT

The present application provides a method of installing an impingement cooling assembly in an inner platform of an airfoil of a turbine nozzle. The method may include the steps of positioning an insert within a cavity of the airfoil, positioning a core exit cover about an opening of the cavity, positioning an impingement plenum within a platform cavity, inserting an unfixed spoolie through an assembly port of the impingement plenum and into an airflow cavity of the insert, and closing the assembly port.

20 Claims, 2 Drawing Sheets

TURBINE NOZZLE ASSEMBLY METHODS

TECHNICAL FIELD

The present application and the resultant patent relate generally to gas turbine engines and more particularly relate to methods for assembling cooling components in an inner platform of a cantilevered turbine nozzle and the like with reduced leakage.

BACKGROUND OF THE INVENTION

Impingement cooling systems have been used with turbine machinery to cool various types of components such as casings, buckets, nozzles, and the like. Impingement cooling systems cool the components via the airflow so as to maintain adequate clearances between the components and to promote adequate component lifetime. One issue with some types of known impingement cooling systems, however, is that they tend to require complicated casting and/or structural welding. Such structures may not be durable or may be expensive to produce and repair. Moreover, the components required for impingement cooling should be tolerant of manufacturing variations and tolerant of thermal differentials between, for example, the nozzle vanes, the shrouds, the sheet metal, the plumbing hardware, and other components. These tolerance requirements may result in significant gaps between the components so as to cause undesirable leakage between pressure cavities.

There is thus a desire for tightly packaged cooling components for use with turbine nozzles and methods of assembling the same. Preferably the cooling components may allow the nozzle to adequately face high gas path temperatures while meeting lifetime and maintenance requirements as well as being reasonable in cost. Moreover, assembly of these components may be simplified and reduce any gaps therebetween that may lead to leakages.

SUMMARY OF THE INVENTION

The present application and the resultant patent provide a method of installing an impingement cooling assembly in an inner platform of an airfoil of a turbine nozzle. The method may include the steps of positioning an insert within a cavity of the airfoil, positioning a core exit cover about an opening of the cavity, positioning an impingement plenum within a platform cavity, inserting an unfixed spoolie through an assembly port of the impingement plenum and into an airflow cavity of the insert, and closing the assembly port.

The present application and the resultant patent further provide an impingement cooling assembly for use in an inner platform of a turbine nozzle. The impingement cooling assembly may include an impingement insert positioned about an airfoil cavity of the nozzle, an impingement plenum with an assembly port positioned about the inner platform and the impingement insert, and a spoolie extending from the impingement plenum about the assembly port and into the airfoil cavity of the nozzle.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
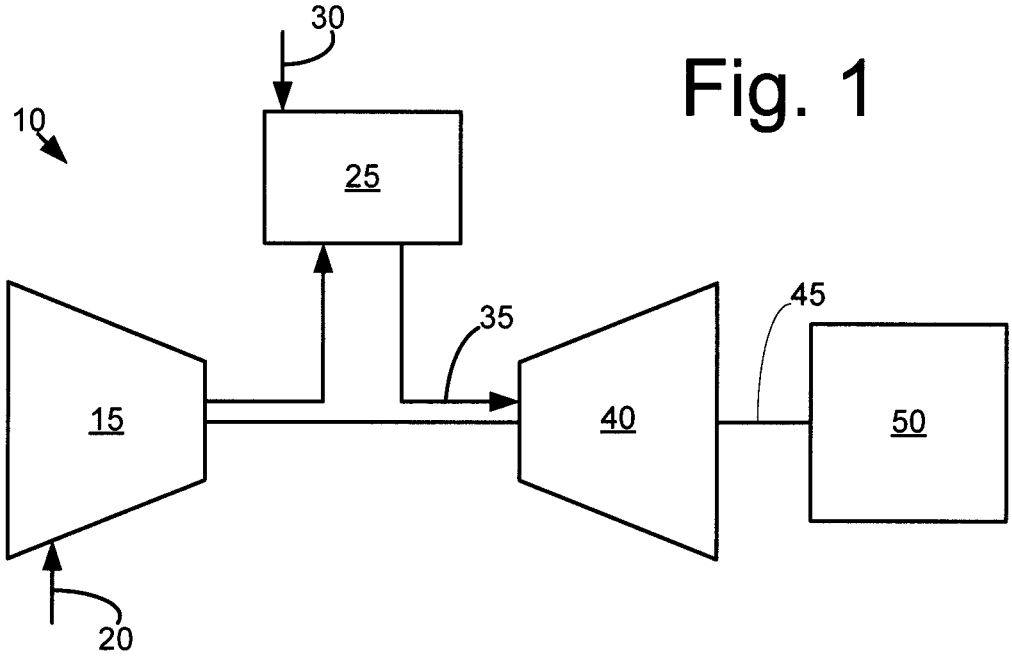
FIG. 1 is a schematic diagram of a gas turbine engine showing a compressor, a combustor, and a turbine.

Referring now to the drawings, in which like numerals refer to like elements throughout the several views, FIG. 1 shows a schematic view of gas turbine engine 10 as may be used herein. The gas turbine engine 10 may include a compressor 15. The compressor 15 compresses an incoming flow of air 20. The compressor 15 delivers the compressed flow of air 20 to a combustor 25. The combustor 25 mixes the compressed flow of air 20 with a pressurized flow of fuel 30 and ignites the mixture to create a flow of combustion gases 35. Although only a single combustor 25 is shown, the gas turbine engine 10 may include any number of combustors 25. The flow of combustion gases 35 is in turn delivered to a turbine 40. The flow of combustion gases 35 drives the turbine 40 so as to produce mechanical work. The mechanical work produced in the turbine 40 drives the compressor 15 via a shaft 45 and an external load 50 such as an electrical generator and the like.

The gas turbine engine 10 may use natural gas, various types of syngas, and/or other types of fuels. The gas turbine engine 10 may be any one of a number of different gas turbine engines offered by General Electric Company of Schenectady, N.Y., including, but not limited to, those such as a 7 or a 9 series heavy duty gas turbine engine and the like. The gas turbine engine 10 may have different configurations and may use other types of components. Other types of gas turbine engines also may be used herein. Multiple gas turbine engines, other types of turbines, and other types of power generation equipment also may be used herein together.

Figure 2:
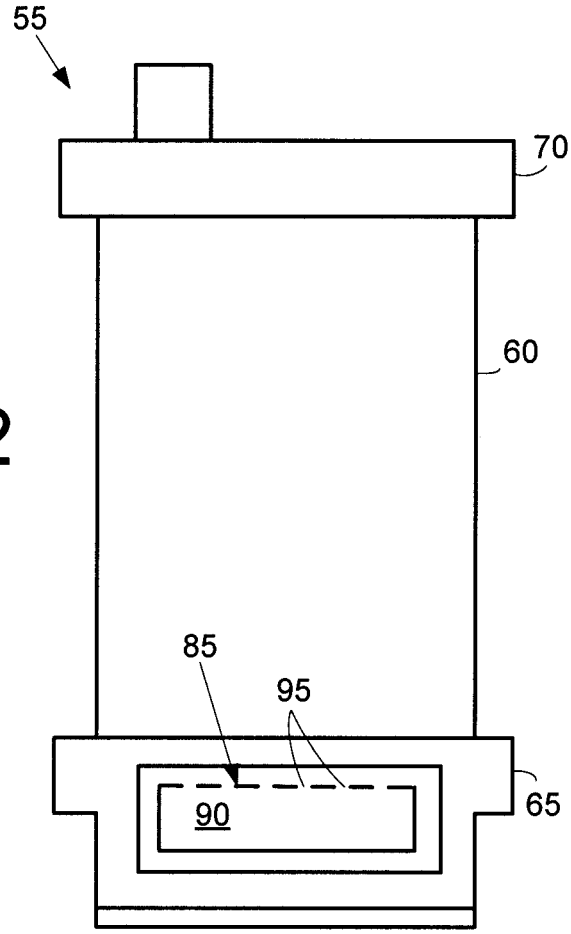
FIG. 2 is a partial side view of a nozzle vane with an impingement cooling assembly therein.

FIG. 2 is an example of a nozzle 55 that may be used with the turbine 40 described above. Generally described, the nozzle 55 may include a nozzle vane 60 that extends between an inner platform 65 and an outer platform 70. A number of the nozzles 55 may be combined into a circumferential array to form a stage with a number of rotor blades (not shown).

The nozzle 55 also may include an impingement cooling assembly 85 with an impingement plenum 90. The impingement plenum 90 may have a number of impingement apertures 95 formed therein. The impingement plenum 90 may be in communication with the flow of air 20 from the compressor 15 or another source via a spoolie or other type of cooling conduit. The flow of air 20 may extend through the nozzle vane 60, into the impingement cooling assembly 85, and out via the impingement apertures 95 so as to impingement cool a portion of the nozzle 55 or elsewhere. Other components and other configurations may be used herein.

Figure 3:
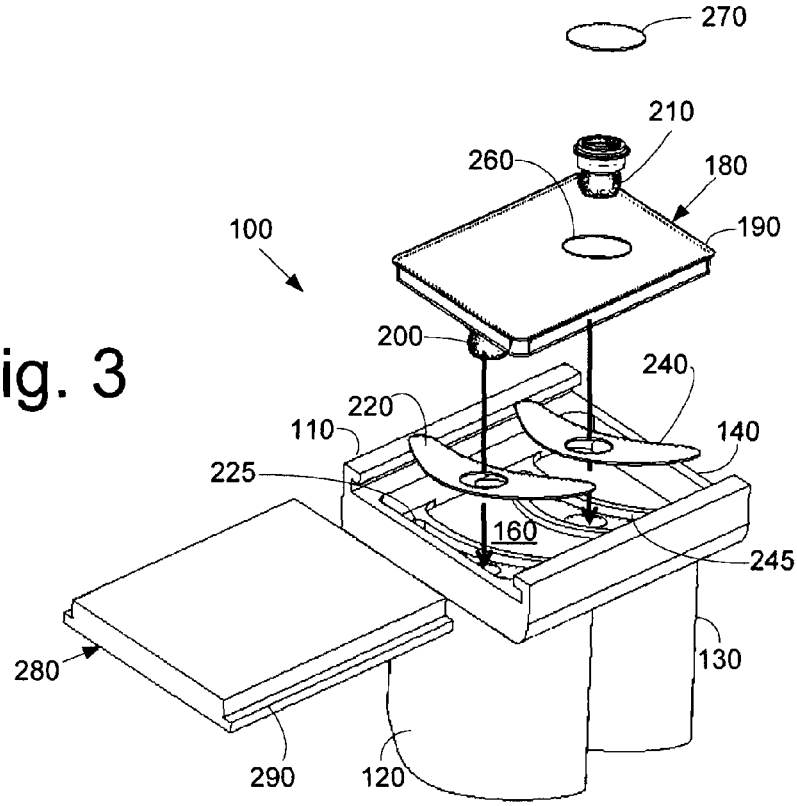
FIG. 3 is an exploded view of a nozzle vane with an impingement cooling assembly as may be described herein.
Figure 4:
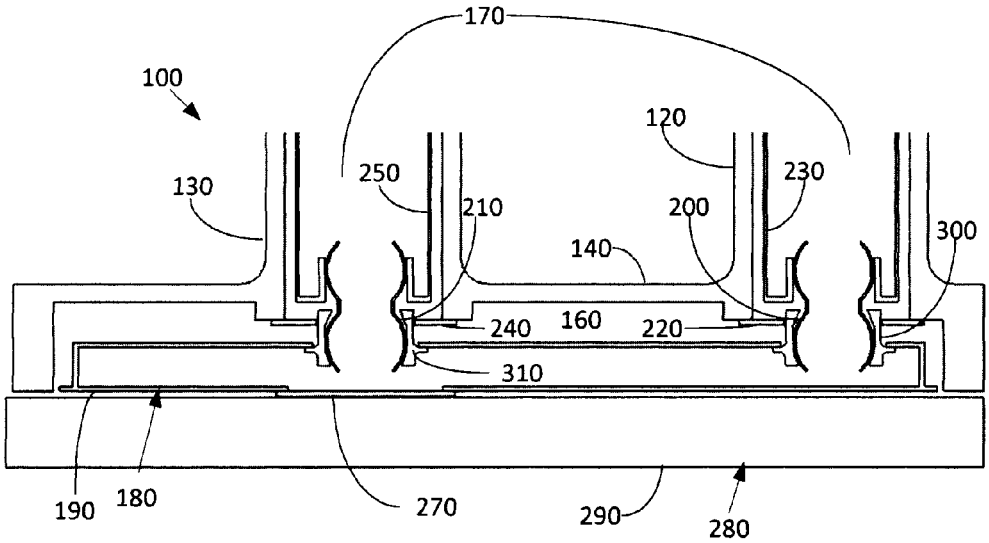
FIG. 4 is a partial section view of the nozzle vane with the impingement cooling assembly of FIG. 3.

FIG. 3 and FIG. 4 show portions of an example of a nozzle 100 as may be described herein. In this example, a multivaned segment 110 is shown with a first vane 120 and a second vane 130. Any number of vanes and any number of segments may be used herein. The vanes 120, 130 may extend from an inner platform 140. The inner platform 140 may a platform cavity 160. Each of the vanes 120, 130 may include an airflow cavity 170 therein. The airflow cavity 170 may be in communication with the platform cavity 160 so as to provide the flow of air 20 from the compressor 15 or elsewhere for impingement cooling. Other components and other configurations may be used herein.

The nozzle 100 also may include an impingement cooling assembly 180 therein. The impingement cooling assembly 180 may include an impingement plenum 190. The impingement plenum 190 may include one or more spoolies or other types of cooling conduits in communication with the flow of air 20 from the airflow cavities 170. The spoolies or conduits may include both coolant passages and housings designed to minimize gaps with interfacing components. In this configuration, a first spoolie 200 and a second spoolie 210 are shown. Any number of spoolies may be used. In this configuration, the first spoolie 200 may be positioned in a first housing 300 and the second spoolie 210 may be positioned in a second housing 310. The nozzle 100 may also include a number of airfoil sheet metal inserts. In this configuration, a first insert 230 may be contained within the first vane 120 and a second insert 250 may be contained within the second vane 130. A core exit cover may be affixed to the exit of each vane cavity. In the current configuration, a first core exit cover 220 may be affixed to an opening 225 of the first vane 120 and a second core exit cover 240 may be affixed to an opening 245 of the second vane 130. The impingement plenum 190 also may include the assembly port 260, an assembly port cover 270, and a retention plate 280. The current example shows a single assembly port and assembly port cover but multiples may be used of each. The impingement plenum 190 and the components thereof may have any size or shape. Other components and other configurations may be used herein.

In order to assemble the impingement cooling assembly 180, the airfoil inserts 230, 250 may be positioned within the airfoil cavities 170. The core exit covers 220, 240 may be welded or otherwise affixed into place. The impingement plenum 190 may be fabricated with the first spoolie 200 welded or otherwise affixed into place. The impingement plenum 190 may be positioned within the platform cavity 160 such that the first spoolie 200 engages the first airfoil insert 230. The second spoolie 210 may be positioned within the assembly port 260 and into engagement with the second airfoil insert 250. The assembly port 260 may be sized to accommodate the spoolies passing therethrough with sufficient provision for alignment of the spoolie with the airfoil insert to minimize the hydraulic gaps between the components. The second spoolie 210 may be welded or otherwise affixed to the impingement plenum 190. The assembly port cover 270 then may be welded or otherwise affixed into place about the assembly port 260. Additional cover plates also may be used. Multiple assembly ports may be used with all of the spoolies being positioned into engagement with airfoil inserts through the assembly ports prior to being affixed to the impingement plenum 190.

The retention plate 280 then may be slid into place circumferentially. The retention plate 280 may take the form of a seal carrier 290 and the like. The retention plate 280 may be held in place via a retention pin or other types of mechanical engagement. Other components, such as seals or gaskets, also may be used herein. Other configurations may be used herein. The order of the installation and assembly steps herein may vary. The impingement cooling assembly 180 thus is assembled from the inner diameter outward.

The impingement cooling assembly 180, and the methods described herein, thus may minimize hydraulic gaps between cavities of differing pressures. Specifically, the methods may minimize cross-cavity leakage while remaining tolerant of manufacturing variations. The impingement cooling assembly 180 may be mechanically retained without complex welding or castings. Lower leakage thus equates to higher overall performance and efficiency.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

We claim:

1. A method of installing an impingement cooling assembly in an inner platform of an airfoil of a turbine nozzle, comprising:

positioning an insert within a cavity of the airfoil;

positioning a core exit cover about an opening of the cavity;

positioning an impingement plenum within a platform cavity;

inserting an unfixed spoolie through an assembly port of the impingement plenum and into an airflow cavity of the insert; and closing the assembly port.

2. The method of claim 1, wherein the step of positioning a core exit cover about the opening of the airfoil cavity comprises covering the airfoil cavity.

3. The method of claim 1, wherein the step of positioning an insert within the airfoil cavity comprises inserting a plurality of impingement inserts into a plurality of airfoil cavities.

4. The method of claim 1, wherein the step of positioning an insert within the airfoil cavity comprises affixing the impingement insert to the airfoil cavity.

5. The method of claim 1, wherein the step of positioning a core exit cover about the opening of the cavity comprises positioning a plurality of core exit covers about a plurality of openings.

6. The method of claim 1, wherein the step of positioning the impingement plenum within the inner platform cavity comprises positioning an impingement plenum with a fixed spoolie into the airfoil cavity.

7. The method of claim 6, wherein the step of positioning the impingement plenum with the fixed spoolie into the cavity comprises positioning the fixed spoolie into the insert and the airfoil cavity.

8. The method of claim 1, wherein the step of inserting an unfixed spoolie through an access port of the impingement plenum comprises affixing the unfixed spoolie to the impingement plenum.

9. The method of claim 8, wherein a plurality of unfixed spoolies is inserted through a plurality of access ports of the impingement plenum.

10. The method of claim 1, wherein the step of closing the assembly port comprises positioning an assembly cover over the assembly port.

11. The method of claim 10, wherein a plurality of assembly covers is positioned over a plurality of assembly ports.

12. The method of claim 1, further comprising the step of sliding a retention plate about the impingement plenum.

13. The method of claim 12, wherein the retention plate comprises a seal carrier.

14. An impingement cooling assembly for use in an inner platform of a turbine nozzle, comprising:

an impingement insert positioned about an airfoil cavity of the nozzle;

an impingement plenum positioned within the inner platform about the impingement insert;

the impingement plenum comprising an assembly port; and a spoolie extending from the assembly port of the impingement plenum and into the airfoil cavity of the nozzle;

wherein the assembly port is about the spoolie.

15. The impingement cooling assembly of claim 14, wherein the nozzle comprises a first vane and a second vane and wherein the spoolie comprises an unfixed spoolie extending from the impingement plenum about the assembly port and into the airfoil cavity of the second vane.

16. The impingement cooling assembly of claim 15, further comprising a fixed spoolie extending from the impingement plenum away from the assembly port and into the airfoil cavity of the first vane.

17. The impingement cooling assembly of claim 14, further comprising an assembly cover enclosing the assembly port.

18. The impingement cooling assembly of claim 14, further comprising a retention plate enclosing the platform.

19. The impingement cooling assembly of claim 18, wherein the retention plate comprises a seal carrier.

20. The impingement cooling assembly of claim 14, wherein the assembly port is sized for the spoolie to pass therethrough.

* * * * *